US006515406B1

(12) United States Patent
Kai et al.

(10) Patent No.: US 6,515,406 B1
(45) Date of Patent: Feb. 4, 2003

(54) HIGH-PRESSURE MERCURY VAPOR DISCHARGE LAMP AND LAMP UNIT

(75) Inventors: Makoto Kai, Katano (JP); Mamoru Takeda, Soraku-gun (JP); Yoshiki Kitahara, Takatsuki (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/890,132

(22) PCT Filed: Feb. 7, 2000

(86) PCT No.: PCT/JP00/00651

§ 371 (c)(1),
(2), (4) Date: Jul. 26, 2001

(87) PCT Pub. No.: WO00/46836

PCT Pub. Date: Aug. 10, 2000

(30) Foreign Application Priority Data

Feb. 5, 1999 (JP) ..... 11-027990

(51) Int. Cl.[7] ..... H01J 5/16; H01J 17/20; H05B 37/00

(52) U.S. Cl. ..... 313/113; 315/200 R; 313/111

(58) Field of Search ..... 315/200 R, 205, 315/246; 313/113, 110, 112, 111, 638, 639, 640, 642, 643

(56) References Cited

U.S. PATENT DOCUMENTS 4,742,268 A * 5/1988 Caruso et al. ..... 313/620
4,757,427 A * 7/1988 Oostvogels et al. ..... 313/111
5,184,044 A * 2/1993 Thomas ..... 313/638
5,479,065 A * 12/1995 Sugimoto et al. ..... 313/113
5,497,049 A 3/1996 Fischer ..... 313/634
6,018,214 A * 1/2000 De Vaan ..... 313/112
6,218,780 B1 * 4/2001 Ehrlichmann et al. ..... 313/22
6,414,436 B1 * 7/2002 Eastlund et al. ..... 313/634

FOREIGN PATENT DOCUMENTS

JP 10-188890 12/1996
JP 10-326596 5/1997

* cited by examiner

*Primary Examiner*—Don Wong
*Assistant Examiner*—Chuc Tran
(74) *Attorney, Agent, or Firm*—Parkhurst & Wendel, L.L.P.

(57) ABSTRACT

A short-arc high-pressure mercury vapor discharge lamp includes a pair of electrodes in an arc tube and encloses mercury, a rare gas, and so forth in the arc tube. The lamp is so constructed as to be operated at a lamp current of, for example, about 1.5 A or higher, or at a lamp voltage/lamp current ratio of about 37.5 (V/A) or lower. In addition, the distance between the electrodes, and the like are set so that the rated power per unit arc length P/d≧88 (W/mm) and the tube wall loading Pw (rated power P/internal surface area of the arc tube)≦1.0 (W/mm$^2$). Thus, a lamp is constructed having, even with a relatively low lamp voltage, a high lamp power of, for example, 125 W or higher, having a short arc length and a high luminous flux per unit arc length, and furthermore being one in which damage to the arc tube does not occur.

3 Claims, 8 Drawing Sheets

HIGH-PRESSURE MERCURY VAPOR DISCHARGE LAMP AND LAMP UNIT

TECHNICAL FIELD

The present invention relates to a short-arc high-pressure mercury vapor discharge lamp including a pair of discharge electrodes opposed to each other in an arc tube and enclosing mercury and a rare gas in the arc tube. The invention further relates to a lamp unit provided with such a high-pressure mercury vapor discharge lamp.

BACKGROUND ART

High-pressure mercury vapor discharge lamps have the advantage of high luminance and therefore, combined with reflectors (for example, parabolic mirrors), are used as the light source for liquid crystal projectors, and so forth. With a trend toward larger screen sizes and higher resolution images, particularly in recent liquid crystal projectors, there has been a demand for lamps that achieve a higher illuminance on the projection screen. In order to obtain such a lamp, it is required to shorten the arc length (distance between the electrodes) and to increase luminous flux by increasing lamp power (rated power and input power).

The above-described shortening of the arc length is required so that light emitted by the lamp reaches the target (the projection screen) with minimal loss. In other words, the closer the light emitting portion (arc) of the lamp is to a point light source, the more loss of converging light caused by the optical system, such as a reflector, can be reduced (i.e., the optical efficiency is improved). More specifically, the luminous flux per unit arc length $\Phi/d$, where $\Phi$ (lm) is the luminous flux and d (mm) is the arc length, is equivalent to the arc luminance L (cd/m$^2$), and this arc luminance L determines the screen illuminance on the projector during projection.

An example of a so-called short-arc lamp, in which the above-described shortening of the arc length is attempted, is disclosed in, for example, Japanese Unexamined Patent Publication No. 2-148561. This lamp is a high-pressure mercury vapor discharge lamp in which the lamp power is set at 30 to 50 W and the arc length is set at 1.0 to 1.2 mm. The above-described arc length is very short as compared to, for example, a 40 W high-pressure mercury vapor discharge lamp for general-purpose illumination (HF40 available from Matsushita Electric Industrial Co., Ltd.) which has an arc length of 12 mm. That is to say, this kind of lamp is distinguished from lamps for general purpose illumination and the like in that it normally has an arc length of about 2 mm or less or at the longest about 3 mm or less. Therefore, in the present invention, an arc having an arc length of 3 mm or less is referred to as "short arc."

The above-described increase in lamp power may be achieved by increasing lamp current or by increasing lamp voltage. However, for a drive circuit that drives a lamp, it is generally easier to increase output voltage than it is to increase current capacity. In addition, when the lamp current is increased, a rise in the temperature of the electrodes is effected by increased Joule loss to the electrodes, and as a result, blackening, caused by vaporization of the electrodes and deposition of this vapor on the inner wall of the arc tube, is more likely to occur. For these reasons, in conventional high-pressure mercury vapor discharge lamps, various methods have been proposed for achieving an increased lamp power by increasing lamp voltage. For example, in a lamp disclosed in the above-described Japanese Unexamined Patent Publication No. 2-148561, by increasing the amount of mercury enclosed and/or by increasing the tube wall loading (lamp power/internal surface area of the arc tube (W/mm$^2$)), the operating pressure of the lamp can be set as high as 200 to 300 atm., to achieve a lamp voltage of 76 to 92 V. In this case, a lamp power of 30 to 50 W is achieved with a lamp current of about 0.33 to 0.66 A. (It should be noted that the lamp power can be easily increased by lengthening the arc length; however, this leads to a reduction in optical efficiency as described above, and therefore it is not possible to achieve a screen illuminance that improves according to the degree of increase in lamp power.)

However, in conventional high-pressure mercury vapor discharge lamps in which the lamp power is increased by increasing the operating pressure and the like as described above, it is difficult to substantially increase lamp power due to a limitation on the strength of the arc tube to withstand pressure.

DISCLOSURE OF THE INVENTION

In view of the foregoing problems, it is an object of the present invention to provide a high-pressure mercury vapor discharge lamp which has a short arc length and achieves a high luminous flux by substantially increasing lamp power.

It is another object of the invention to provide a lamp unit utilizing such a high-pressure mercury vapor discharge lamp.

In order to achieve the above-described substantial increase in lamp power, first, the present inventors tried increasing lamp voltage. However, although the operating pressure of a lamp varies by the size, shape, or the like of the arc tube, the highest possible operating pressure is about 400 atm. In addition, while the operating pressure of a lamp is proportional to the amount of mercury enclosed, the lamp voltage is proportional to only about ½ power of the amount of mercury enclosed (Elenbaas, "The High Pressure Mercury Vapour Discharge," North-Holland Publishing Company, 1951, p30). For this reason, it was difficult to increase lamp voltage to about 90 V or higher, and thus impossible to substantially increase lamp power to, for example, about 125 W or higher. As a result, the highest achievable light output was about 60 (lm/W). (It should be noted that a limitation on the strength of the arc tube to withstand pressure such as described above is due to the limitations of the sealing technique. However, improvement in sealing technique, by which a substantial increase in strength to withstand pressure can be obtained, is not easily achieved, as there are still many technical problems to overcome.)

Further, since it was difficult to increase lamp voltage above the above-described level, the present inventors thought of another technique wherein after having increased lamp voltage as much as possible, lamp current is increased. In doing so, however, an increase in electrode diameter is required in order to reduce Joule loss to the electrodes such as was described above and prevent blackening of the arc tube. However, an increase in electrode diameter increases the area of contact between the sealing portions and the electrodes in the arc tube, causing very small cracks or gaps to be more likely to occur. In other words, because the strength of the sealing portions is reduced, the probability of damage to the arc tube is increased. Hence, in this case also, because there was a limitation on the strength of the arc tube to withstand pressure, it was not possible to substantially increase the lamp current (specifically, above about 1 A, for example), and therefore it was difficult to substantially increase lamp power.

At this point, in order to achieve a substantial increase in lamp power, further and various studies were carried out. From these studies, it was found that the limitations of the drive circuit in terms of an increase in the lamp current such as described above have technically nothing to with the drive circuit itself. In addition, the problem of the strength of the arc tube to withstand pressure, which accompanies an increase in electrode diameter intended to prevent blackening of the arc tube, in fact is due to the approach adopted as described above in which the operating pressure is increased so as to increase the lamp voltage. Thus, the present inventors came up with an approach in which the lamp power may be increased by increasing the lamp current while allowing for a reduction in the lamp voltage.

In other words, power is basically the product of current and voltage, and thus, electrically speaking, an increase in power is equivalent to an increase in voltage and an increase in current. However, in actual high-pressure mercury vapor discharge lamps, when the operating pressure is restricted to a low pressure while allowing for a reduction in the lamp voltage, the limitation on the strength of the arc tube to withstand pressure is reduced. Thus, the electrode diameter may be easily increased to such a level that the arc tube is not damaged and further blackening of the arc tube can be prevented. As a result, the present inventors have found that it is possible to increase the lamp current to such a level that the reduction in the lamp voltage can be sufficiently compensated, and therefore a much higher lamp power than that of conventional lamps is achievable. Thus, the present invention was accomplished.

The foregoing objects are accomplished in accordance with the present invention by providing a short-arc high-pressure mercury vapor discharge lamp comprising a pair of discharge electrodes opposed to each other in an arc tube and enclosing at least mercury and a rare gas in the arc tube, wherein:

the high-pressure mercury vapor discharge lamp may be so constructed as to be operated at a lamp current of 1.5 A or higher, and preferably at 2 A or higher, or to be operated at a lamp voltage/lamp current ratio of approximately 37.5 (V/A) or lower. The above-described short arc here implies an arc having an arc length of 3 mm or less as described above.

By operating the lamp at a high lamp current as described above, a high lamp power is achieved with a relatively low lamp voltage. In addition, because the lamp voltage is relatively low, it is possible to set the operating pressure of the lamp at a low pressure, thereby reducing the limitation on the strength of the arc tube to withstand pressure, and thus the electrode diameter can be easily increased. That is to say, Joule loss can be reduced and the temperature of the electrodes can be restricted to a low temperature by increasing heat conduction, thereby preventing blackening of the arc tube, and thus a longer lamp life is also achieved.

In the above-described high-pressure mercury vapor discharge lamp, the rated power and the internal surface area of the arc tube may be set so that the tube wall loading Pw ($Pw=P/Sb$) ($W/mm^2$) is 1.0 ($W/mm^2$) or lower, where Sb ($mm^2$) is the internal surface area of the arc tube.

Thus, by setting the tube wall loading to a low value, a high lamp power as described above is achieved, the arc tube is less subject to blackening, and furthermore prevention of damage to the arc tube is ensured.

The above-described high-pressure mercury vapor discharge lamp may be constructed so that the rated power P (W) is such that $P \geqq 125$ (W).

In other words, when a lamp is operated at a high lamp current as described above, such a high rated power is attained, and thus a high-pressure mercury vapor discharge lamp that emits a high luminous flux can be obtained.

In the above-described high-pressure mercury vapor discharge lamp, the distance between the electrodes and the rated power may be set so that the rated power per unit arc length P/d (W/mm) is such that $P/d \geqq 88$ (W/mm), where d (mm) is the arc length and P (W) is the rated power.

Thus, because the rated power per unit arc length is sufficiently high, a luminous flux per unit arc length of, for example, 5800 (lm/mm), which is required for a liquid crystal projector, is achieved.

In the above-described high-pressure mercury vapor discharge lamp, the distance between the electrodes, the rated power, the type of fill material, and the amount of fill material may be set so that the luminous flux per unit arc length is 5800 (lm/mm) or higher.

In other words, by operating the lamp at a high lamp current as described above, such a high luminous flux per unit arc length is achieved. Therefore, when, for example, the lamp is utilized in combination with a reflector and so forth, as is the case with a liquid crystal projector, a high optical efficiency and a high luminance are easily achieved.

In the above-described high-pressure mercury vapor discharge lamp, the type of fill material, the amount of fill material, the shape of the arc tube, the cross sectional area in the vicinity of tips of the electrodes, the distance between the electrodes, and the rated power may be set so that the rated power per unit volume of a discharge arc formed between the electrodes $E \cdot j$ ($W/mm^3$) is such that $E \cdot j \geqq 700$ ($W/mm^3$), where E ($E=V/d$) (V/mm) is the lamp voltage per unit arc length, V (V) being the lamp voltage at stable operation and d (mm) being the arc length, and j ($j=I/Se$) ($A/mm^2$) is the current density at the tips of the electrodes, I (A) being the lamp current at stable operation and Se ($mm^2$) being the cross sectional area in the vicinity of the tips of the electrodes.

Thus, in this case also, it is possible to increase the rated power per unit arc length with no damage to the arc tube. Consequently, a high luminous flux per unit arc length, for example, a luminous flux per unit arc length of 5800 (lm/mm) as described above, which is required for a liquid crystal projector, is achieved.

The above-described high-pressure mercury vapor discharge lamp may further enclose at least one member selected from the group consisting of a halogen gas, a nonmetallic halide, and a metal halide, in the arc tube.

Thus, the so-called halogen cycle takes place in the arc tube, thereby preventing vaporized electrode material from depositing on the inner wall of the arc tube and preventing reduction in the light transmittance of the wall of the arc tube. Therefore, blackening of the arc tube is controlled, and thus a longer lamp life is achieved.

The present invention further provides a lamp unit comprising:

the above-described high-pressure mercury vapor discharge lamp; and a reflector for reflecting light emitted by the above-described high-pressure mercury vapor discharge lamp such that the light is converted into a parallel beam, a convergent beam in which light converges to a predetermined micro-area, or a divergent beam which is substantially the same as light diverged from a predetermined micro-area.

Thus, since the arc length is short, a high optical efficiency is achieved. In addition, since the luminous flux per unit arc length is high, it is possible to display brighter images in an image display system, such as a liquid crystal projector.

BEST MODE FOR CARRYING OUT THE INVENTION

The present invention is explained in more detail below according to the embodiment thereof.

Figure 1:
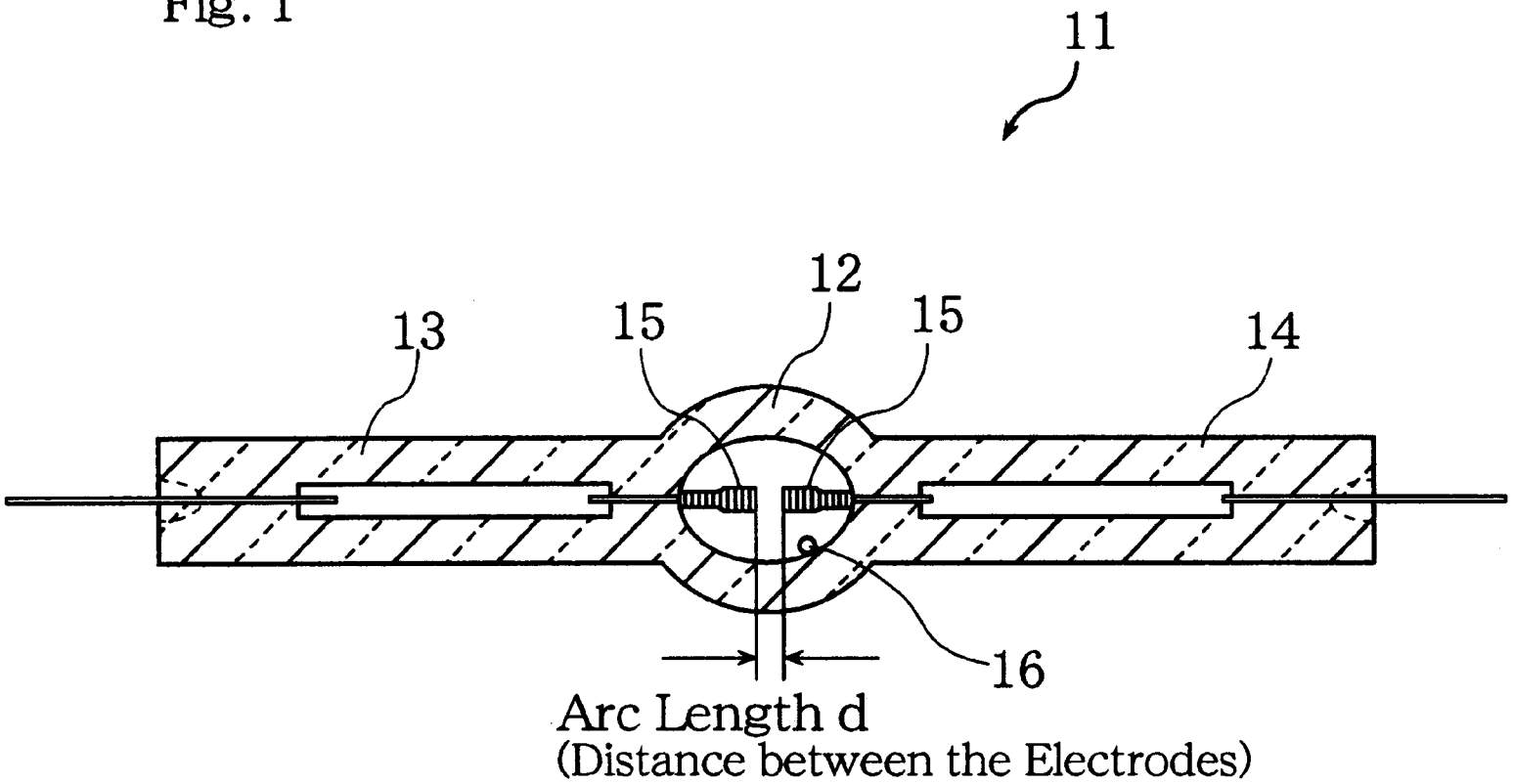
FIG. 1 is a cross sectional view showing the construction of a high-pressure mercury vapor discharge lamp according to the embodiment of the present invention.

FIG. 1 is a cross sectional view showing the construction of a high-pressure mercury vapor discharge lamp in accordance with the embodiment of the present invention.

This lamp 11 comprises an arc tube 12 having sealing portions 13 and 14 at the ends. In the arc tube 12, a pair of coil or rod-shaped discharge electrodes 15 composed of tungsten is provided, and mercury 16 and a rare gas and so forth, which are not shown in the figure, are enclosed.

The above-described lamp 11 is set according to, for example, the following specifications.

| (Sample lamp : Group 1) | |
|---|---|
| Lamp power P | 150 W |
| Lamp voltage | Approximately 65 to 75 V |
| Lamp current | Approximately 2.3 to 2.0 A |
| Arc length d | Approximately 1.4 to 1.9 mm |
| Tube wall loading Pw | 0.84 to 0.96 W/mm$^2$ |
| Diameter of electrode rods Φ | 0.4 mm |
| Operating pressure | Approximately 150 atmospheres (15 MPa) |

| (Sample lamp : Group 2) | |
|---|---|
| Lamp power P | 200 W |
| Lamp voltage | Approximately 70 V |
| Lamp current | Approximately 2.9 A |
| Arc length d | Approximately 1.5 mm and 1.6 mm |
| Tube wall loading Pw | 0.90 W/mm$^2$ |
| Diameter of electrode rods Φ | 0.4 mm |
| Operating pressure | Approximately 150 atmospheres (15 MPa) |

Figure 2:
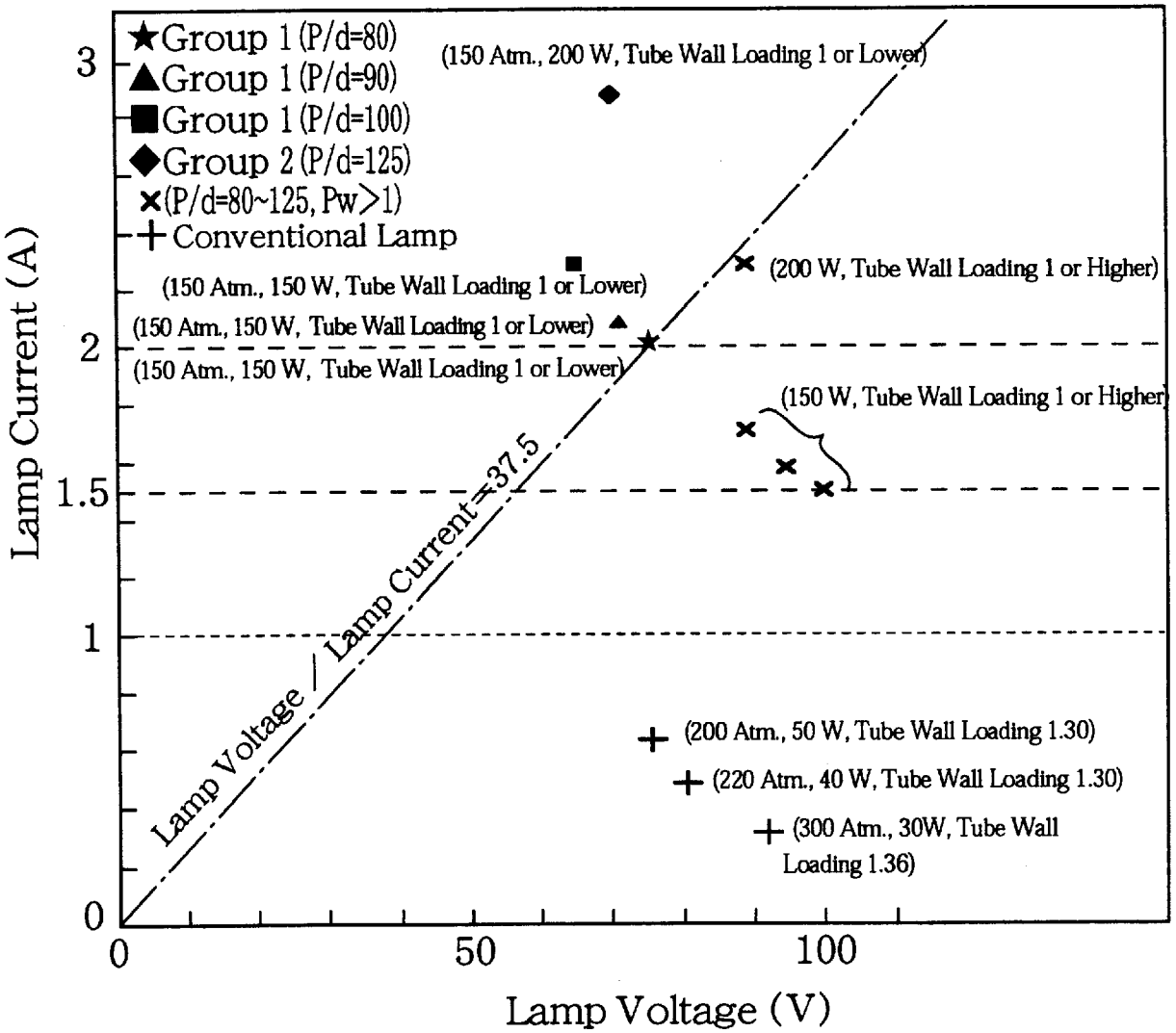
FIG. 2 is a graph showing lamp current versus lamp voltage.

A comparison of these sample lamps and conventional high-pressure mercury vapor discharge lamps, as typified by Japanese Unexamined Patent Publication No. 2-148561 described in the Background Art section, was made in terms of the relationship between lamp current and lamp voltage. The results are as shown in FIG. 2. The symbols in FIG. 2 refer to the followings:

(1) The symbols ★, ▲, and ■ denote the above-described sample lamps of the group 1, in which the arc length d is set at about 1.9 (mm), 1.7 (mm), and 1.5 (mm), respectively (the specific power P/d, which is discussed later, is set at about 80 (W/mm), 90 (W/mm), and 100 (W/mm), respectively).

(2) The symbol ♦ denotes sample lamps of the group 2, in which the arc length d is set at about 1.5 (mm) and 1.6 (mm), respectively (the specific power P/d is set at about 125 (W/mm) and 133 (W/mm), respectively). (3) The symbol × denotes a lamp having the same construction as the sample lamps of the groups 1 and 2, in which the tube wall loading Pw is set to greater than 1.0 (W/mm$^2$).

(4) The symbol + denotes a conventional lamp.

Despite the fact that each of the above-described sample lamps has a relatively low lamp voltage, the lamps achieve a very high lamp power because the lamps have high lamp currents. In addition, even if such a high current is fed to the lamps, because the diameter of the electrode rods is large, the arc tubes are less subject to blackening and a longer lamp life is achieved. That is to say, when the diameter of the electrode rods is large, even if the lamp current is increased, the temperature of the electrodes is restricted to a low temperature because Joule loss is minimal and heat conduction is large. Thus, the vaporization of the electrodes can be suppressed.

It should be noted, however, that when the diameter of the electrode rods is increased, generally, the strength of the sealing portions to withstand pressure tends to decrease. For this reason, in the lamps having a tube wall loading Pw of higher than 1.0 (W/mm$^2$), which are denoted by the symbol × in FIG. 2, the arc tubes were damaged within 100 hours of operation due to insufficient strength to withstand pressure. However, as is the case with the above-described sample lamps, by setting the operating pressure and the tube wall loading to low values, the arc tube is made less subject to damage. That is to say, when the operating pressure and the tube wall loading are appropriately set such that the lamp current is about 1.5 A or higher, and preferably at 1.75 A or higher, and more preferably at 2 A or higher, and/or the lamp voltage/lamp current ratio is about 37.5 (V/A) or lower, it is possible to obtain a lamp which, even with a relatively low lamp voltage, has a high lamp power of, for example, 125 W or higher, and is not easily subject to damage. It should be noted that the tube wall loading and the lamp damage as describe above will be discussed later.

Figure 3:
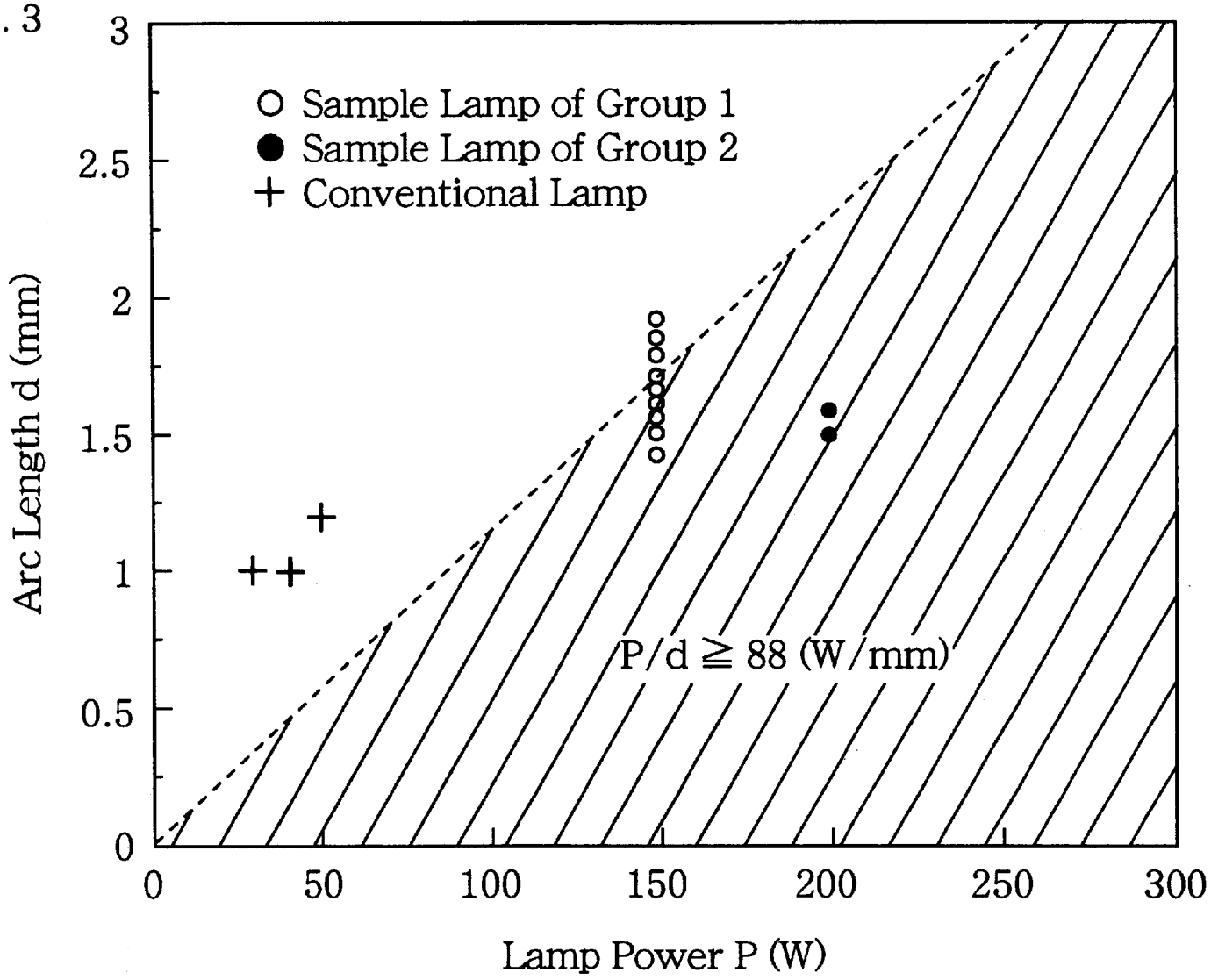
FIG. 3 is a graph showing the rated power P versus the arc length d.

A comparison of the above-described sample lamps and a conventional lamp was made in terms of the ratio of the lamp power P to the arc length d, i.e., the lamp power per unit arc length (hereinafter referred to as "specific power") P/d. As shown in FIG. 3, the sample lamps also differ from the conventional lamp in that most of the sample lamps have a specific power of 88 (W/mm) or higher. In FIG. 3, the symbol β denotes a sample lamp of the group 1, the symbol ● denotes a sample lamp of the group 2, and the symbol + denotes a conventional lamp. The shaded region indicates a range where the lamp power P and the arc length d are such that the specific power P/d≧88 (W/mm), which is discussed later.

Figure 4:
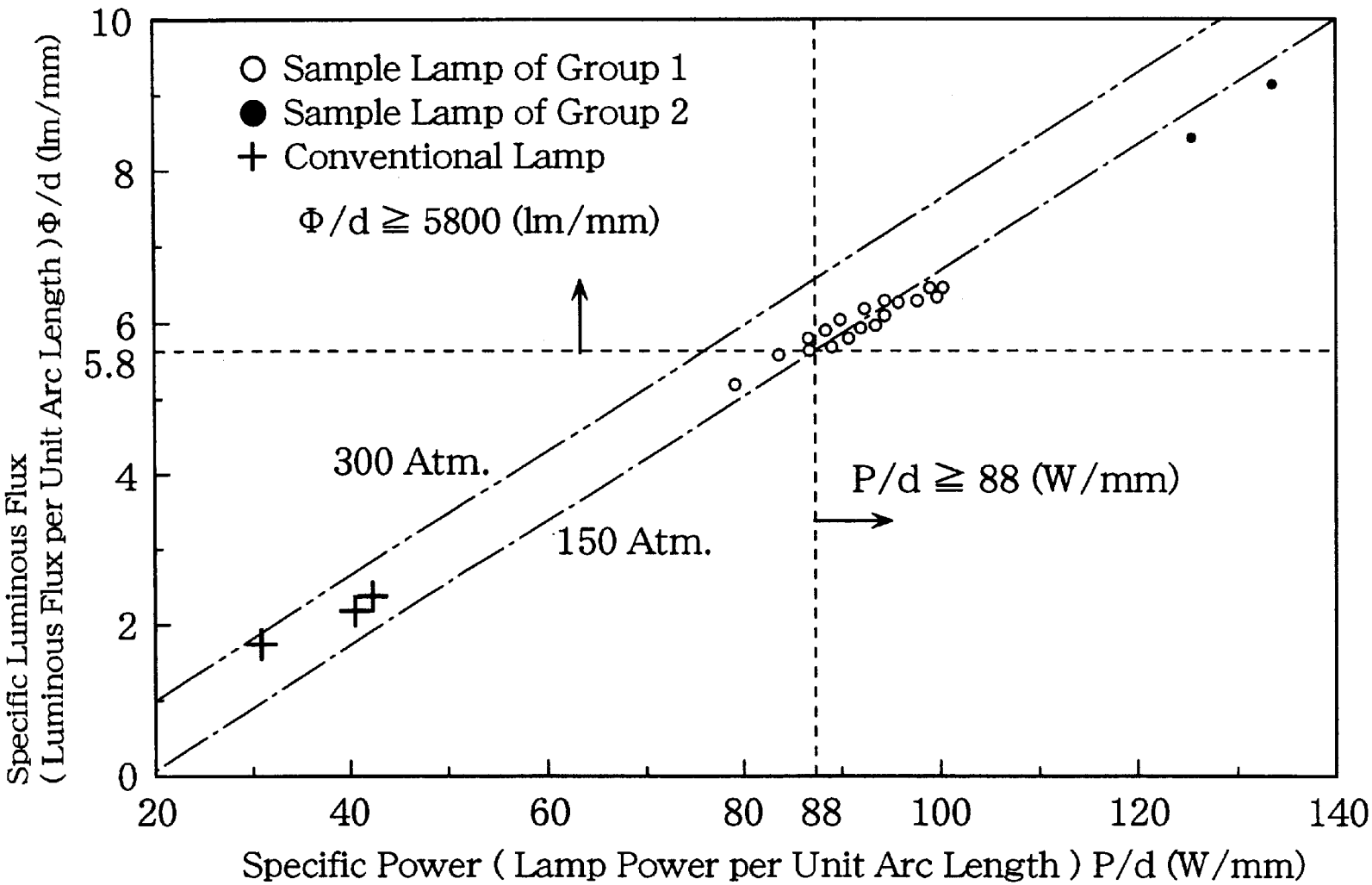
FIG. 4 is a graph showing the relationship between the specific power P/d and the specific luminous flux Φ/d.

In each of the sample lamps and the conventional lamp such as described above, the luminous flux Φ was measured and the relationship between the specific power P/d (W/mm) and the luminous flux per unit arc length (hereinafter referred to as "specific luminous flux") Φ/d (lm/mm) was investigated. The results are as shown in FIG. 4 (each plot symbol in FIG. 4 is the same as that in FIG. 3.). From this study, it became clear that when the lamps have the same operating pressure (about 150 atm.), the relationship between the specific power P/d and the specific luminous flux Φ/d for the lamps lies almost on a straight line (the dot-dash line in the figure), and the specific luminous flux Φ/d increases linearly with increased specific power P/d. The above-described specific luminous flux Φ/d is equivalent to the arc luminance L (cd/m$^2$), and this arc luminance L determines the screen illuminance of the projector during projection. Therefore, without directly controlling the lamp power P, by increasing the specific power P/d to increase the arc luminance L, it is possible to increase the screen illuminance. In the case where the operating pressure is about 150 atm. as described above, by setting the lamp power P and the arc length d such that the specific power P/d≧88 (W/mm), a specific luminous flux of, for example, 5800 (lm/mm), which is required for a liquid crystal projector, is achieved. (In FIG. 4, the point where the dot-dash line, indicating the relationship between the specific power and the specific luminous flux for the lamp having an operating pressure of 150 atm., and the dashed line, indicating a specific luminous flux of 5800 (lm/mm), intersect is the point at which the specific power P/d=88 (W/mm).)

The influence of the operating pressure on the lamp in terms of the relationship between the specific power P/d and the specific luminous flux Φ/d is as follows: The straight lines in FIG. 4 that indicate the relationship between the specific power P/d and the specific luminous flux Φ/d shift upward as the operating pressure increases, as is indicated by, for example, the dot-dot-dash line showing the case in which the operating pressure of the lamp is 300 atm., which is close to the operating pressure of a conventional lamp. That is to say, by increasing the operating pressure, the same specific luminous flux can be obtained with an even lower specific power; however, in conventional lamps, it is not possible to achieve a sufficient specific luminous flux by operating pressures within the range of realistically attainable operating pressures.

Now, the tube wall loading is explained. This tube wall loading is represented by the lamp power/internal surface area of the arc tube (W/mm$^2$). In, for example, a comparison of lamps having the same level of lamp power and the same amount of mercury enclosed, a larger tube wall loading value results with a lamp having an arc tube with a small internal surface area (generally, an arc tube having a small volume). In this case, the operating pressure is also increased, and hence variation in the tube wall loading nearly corresponds to variation in the operating pressure of the lamp. Thus, the above-described wall tube loading is used as a measure of the operating pressure.

Figure 5:
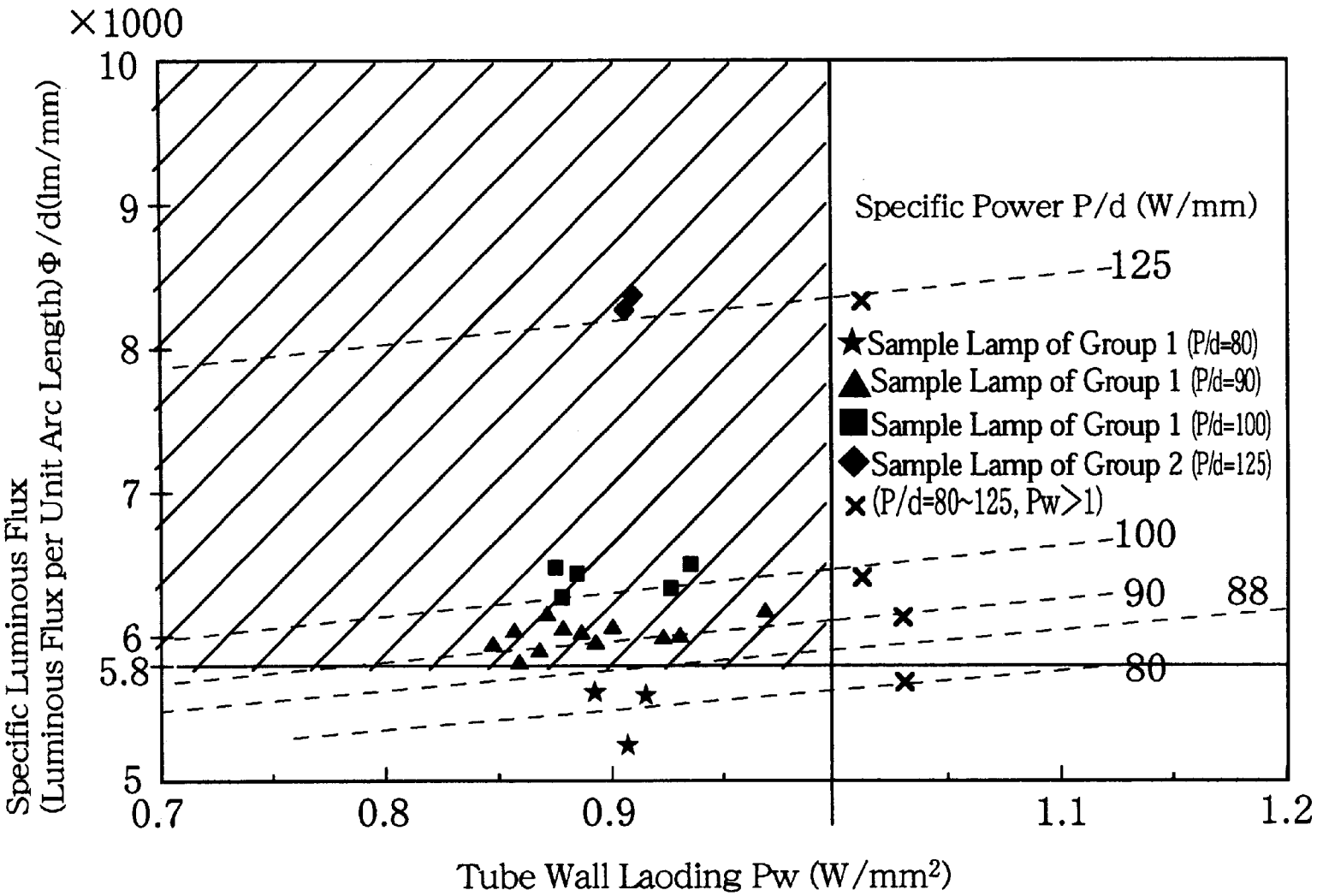
FIG. 5 is a graph showing the relationship between the tube wall loading Pw and the specific luminous flux Φ/d.

FIG. 5 is a graph in which the specific luminous flux Φ/d (lm/mm) is plotted against the tube wall loading Pw (W/mm$^2$) with the specific power P/d (W/mm) as a parameter (each plot symbol in FIG. 5 is the same as that in FIG. 2).

As shown in FIG. 5, the lamps having a tube wall loading of higher than 1.0 (W/mm$^2$) achieve a somewhat higher specific luminous flux than the lamps having the same specific power and a tube wall loading of 1.0 (W/mm$^2$) or lower. However, in these lamps, all the arc tubes were damaged within 100 hours of operation due to insufficient strength to withstand pressure. On the other hand, in the lamps having a tube wall loading of 1.0 (W/mm$^2$) or lower, such damage to the arc tube did not occur over an extended period of time in any of the lamps having a specific power of about 80 to 125 (W/mm).

Therefore, as shown in the shaded area in FIG. 5, by setting the lamp power and the arc length such that the specific power P/d is about 88 (W/mm) or higher and by setting the lamp power and the size of the arc tube such that the tube wall loading is 1.0 (W/mm$^2$) or lower, it is possible to achieve a specific luminous flux of 5800 (lm/mm) and to prevent the occurrence of damage to the arc tube even when the specific power is high as described above.

Figure 6:
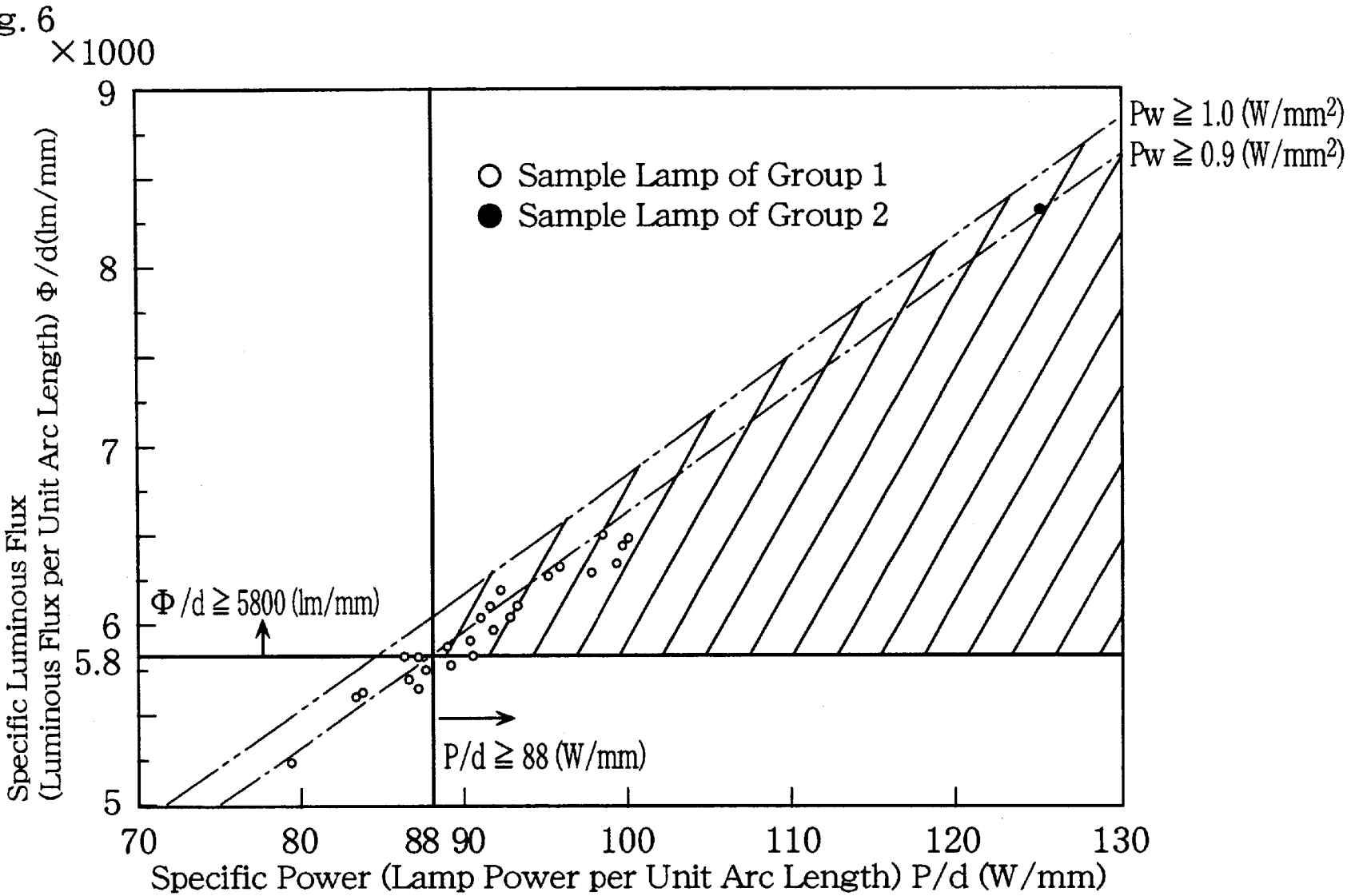
FIG. 6 is a graph showing the relationship between the specific power P/d and the tube wall loading Pw and the specific luminous flux Φ/d.

As with the foregoing FIG. 4, FIG. 6 shows the influence of the tube wall loading in terms of the relationship between the specific power P/d and the specific luminous flux Φ/d. It should be noted that the plots in the figure are of sample lamps (with operating pressures of about 150 atm. and tube wall loadings of about 0.9 (W/mm$^2$)) and are the same as those in FIG. 4. In the figure, the dot-dash line and the dot-dot-line indicate the relationship between the specific power P/d and the specific luminous flux Φ/d when the tube wall loading is 0.9 (W/mm$^2$) and 1.0 (W/mm$^2$), respectively. The shaded area is an area such that the tube wall loading Pw≦1.0 (W/mm$^2$), the specific power P/d≧88 (W/mm), and the specific luminous flux Φ/d≧5800 (lm/mm).

Figure 7:
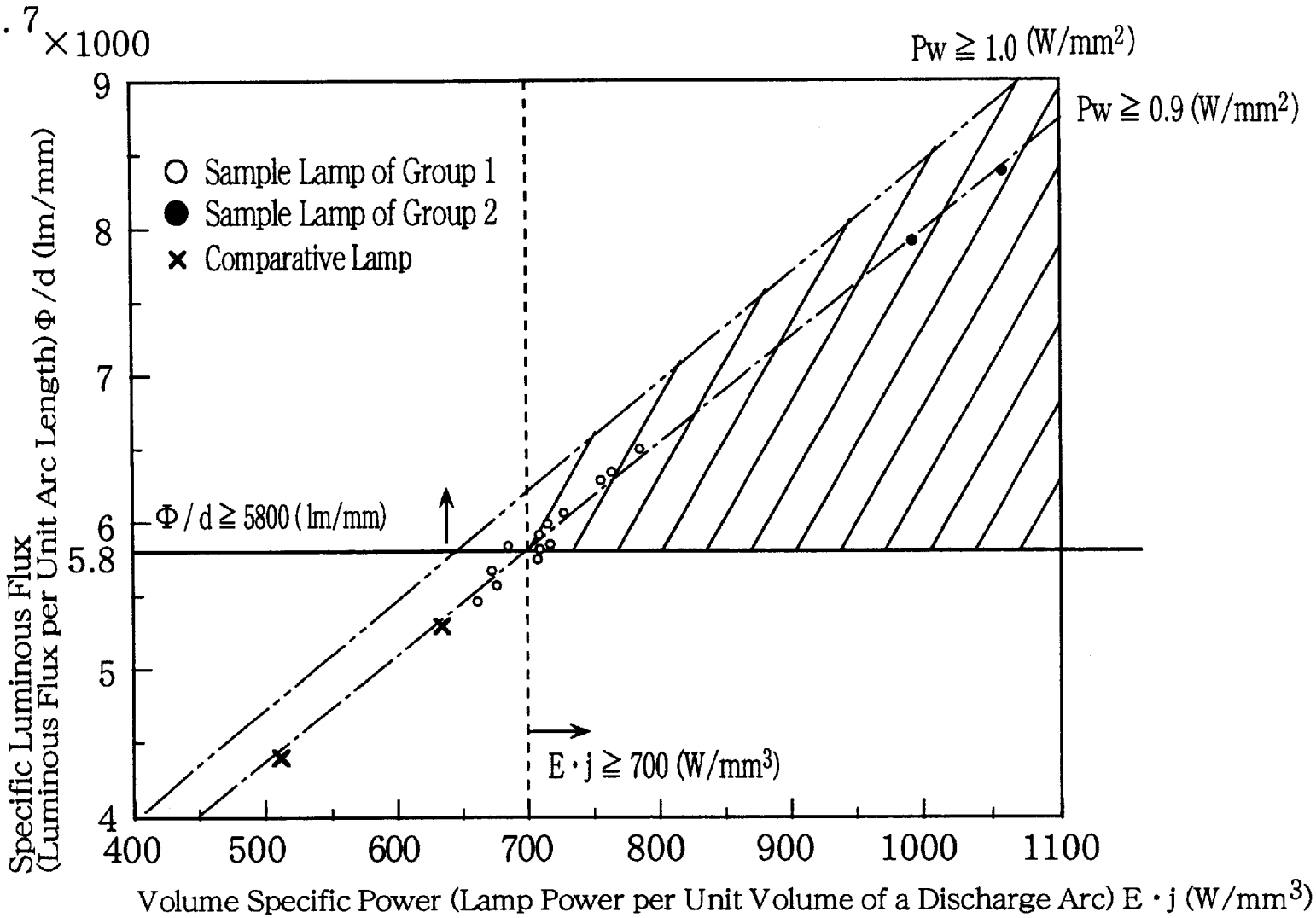
FIG. 7 is a graph showing the relationship between the volume specific power P/d and the specific luminous flux Φ/d.

Referring now to FIG. 7, the relationship between the lamp power per unit volume of a discharge arc formed between the electrodes (hereinafter referred to as "volume specific power") E·j (W/mm$^3$) and the specific luminous flux is explained. For the above-described volume specific power E·j, E is the lamp voltage per unit arc length (E=V/d (V/mm), where V is the lamp voltage at stable operation) and j is the current density at the tips of the electrodes (j=I/Se (A/mm$^2$), where I is the lamp current (lamp current at stable operation) and Se is the surface area of the tips of the electrodes (this is actually a cross sectional area in the vicinity of the tips of the electrodes)). It should be noted that, in general, in the high-pressure mercury vapor discharge lamp the electrode temperature rises as high as 3000 (K) or higher, and therefore there is a possibility that the tips of the electrodes contacting the discharge arc be melted and transformed during operation. In such a case, even if the above-described current density at the tips of the electrodes j (A/mm$^2$) is defined such that j=I/Sj (A/mm$^2$), where the cross sectional area of the electrode rods Sj (mm$^2$) is used as the above-described surface area of the tips of the electrodes Se, the current density at the tips of the electrodes is essentially the same as when j is defined by j=I/Se (A/mm$^2$).

In FIG. 7, the symbol ○ denotes a sample lamp of the group 1, and the symbol ● denotes a sample lamp of the group 2. The symbol × denotes lamps for comparison (comparative lamps) having the following specifications. These comparative lamps differ from the sample lamps 1 and 2 mainly in the diameter of the electrode rods.

| | |
|---|---|
| Lamp power P | 150 W |
| Arc length d | 1.5 mm |
| Tube wall loading Pw | 0.90 W/mm$^2$ |
| Diameter of electrode rods Φ | 0.45 mm and 0.5 mm |
| Operating pressure | Approximately 150 atmospheres |

It is clear from this figure that the higher the volume specific power E·j, the higher the specific luminous flux Φ/d. On the other hand, as was the case with the comparative lamps, when the electrode diameter was large and thus the volume specific power E·j low, the specific luminous flux Φ/d was reduced to lower than 5800 (lm/mm), and in addition the arc tubes of these comparative lamps were damaged within 100 hours of operation due to insufficient strength to withstand pressure. That is to say, the probability of damage within 100 hours of operation rises when the volume specific power E·j is at or below the boundary where the volume specific power E·j=about 650 to 700 (W/mm$^3$). This high probability of damage to the arc tube is due to the fact that the operating pressure is set at a relatively low pressure of about 150 atm., though the surface area of the tips of the electrodes Se is large. In other words, because the effect of increasing the area of contact between the arc tube material of the sealing portions and the electrode rods, brought about by increasing the electrode diameter, is great, very small cracks or gaps are more likely to occur, leading to a reduction in the strength of the arc tube to withstand pressure.

As for the tube wall loading, the straight lines in FIG. 7 that indicate the relationship between the volume specific power E·j and the specific luminous flux Φ/d shift upward as the tube wall loading increases, as is indicated by, for example, the dot-dash line and the dot-dot-dash line which show cases in which the tube wall loading Pw=0.9 (W/mm$^2$) and 1.0 (W/mm$^2$), respectively. That is to say, by increasing the tube wall loading, the same specific luminous flux can be obtained with an even lower specific power. It should be noted, however, that when the tube wall loading is higher than 1.0 (W/mm$^2$), the arc tube may be easily subject to damage as described above, and therefore it is preferable that the tube wall loading be set at 1.0 or lower.

The shaded area in FIG. 7 is an area such that the luminous flux per unit arc length ΦD/d≧5800 (lm/mm) (this is equivalent to the specific power P/d≧88 (W/mm) in FIG. 4), the tube wall loading Pw≦1.0 (W/mm$^2$), and E·j≧700 (W/mm$^3$). By operating a lamp in this range, it is possible to obtain a lamp having a higher lamp power than that of a conventional lamp, and furthermore being one that is not damaged during operation.

Figure 8:
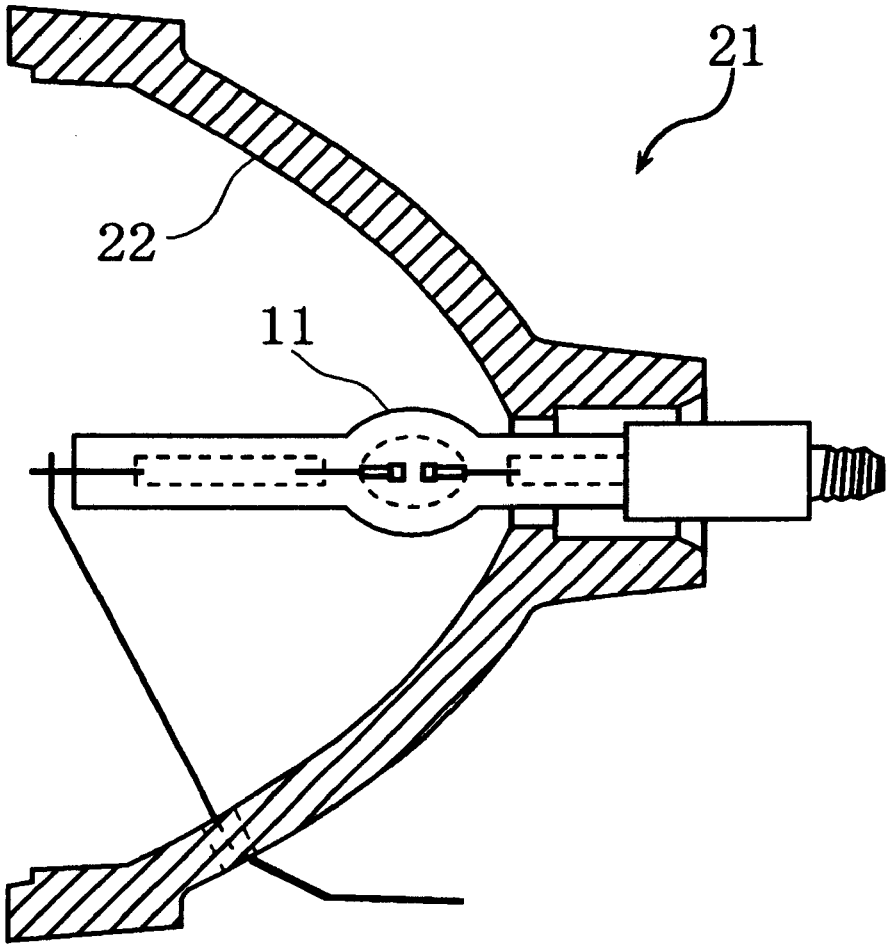
FIG. 8 is a cross sectional view showing the construction of a lamp unit provided with the high-pressure mercury vapor discharge lamp according to the embodiment of the present invention.

Now, a general application of a high-pressure mercury vapor discharge lamp constructed in such a manner as described above is explained. FIG. 8 is a cross sectional view showing an example of a lamp unit 21 utilizing a lamp 11 such as the one described above. This lamp unit 21 is constructed by combining the lamp 11 and a reflector 22. For the above-described reflector 22, for example, a parabolic mirror or an ellipsoidal mirror is utilized. The reflector 22 reflects light emitted by the lamp 11 such that the light is converted into a parallel beam, a convergent beam in which light converges to a predetermined micro-area, or a divergent beam which is substantially the same as light diverged from a predetermined micro-area. The lamp unit 21 such as the one described above is utilized by disposing it in, for example, the main body of a liquid crystal projector. Because the arc length is short as described above, a high optical efficiency is achieved, and in addition, because the specific luminous flux is high, a brighter image can be displayed.

It should be noted that in the foregoing example, mercury 16 and a rare gas are enclosed in an arc tube 12 as the fill material, but this is not the only possibility; a halogen gas, a nonmetallic halide, such as a methyl bromide, a metal halide, such as a mercury bromide, or the like, for example, may further be enclosed in the arc tube. In this case, the so-called halogen cycle takes place in the arc tube 12 during operation, thereby preventing vaporized tungsten from depositing on the inner wall of the arc tube 12. In doing so, it is further possible to prevent a reduction in the light transmittance of the wall of the arc tube 12 and to achieve a longer lamp life.

It should also be noted that lamp specifications are not limited to those described above; various settings may be specified. More specifically, the foregoing example is that of a lamp having an arc length of, for example, 2 mm or less, but even with a lamp having an arc length of, for example, 3 mm or less, the same effect as that of the foregoing example is achieved.

INDUSTRIAL APPLICABILITY

As has been described thus far, according to the present invention, a lamp is so constructed as to be operated, for example, at a lamp current of 1.5 A or higher, or at a lamp voltage/lamp current ratio of about 37.5 (V/A) or lower. By this construction, a high lamp power is achieved with a relatively low lamp voltage, and thus it is possible to obtain a lamp with a short arc length that achieves a high luminous flux by substantially increasing lamp power. Further, by setting the distance between the electrodes and the like so that the tube wall loading Pw (rated power P/internal surface area of the arc tube)≦1.0 (W/mm$^2$) and the rated power per unit arc length P/d≧88 (W/mm), a lamp is constructed having, even with a relatively low lamp voltage, a high lamp power of, for example, 125 W or higher, having a short arc length and a high luminous flux per unit arc length, and furthermore being one in which damage to the arc tube does not occur. Thus, the present invention is advantageous in the fields of, for example, the image display system, such as a liquid crystal projector.

What is claimed is:

1. A short-arc high-pressure mercury vapor discharge lamp comprising a pair of discharge electrodes opposed to each other in an arc tube and enclosing only mercury and a rare gas in said arc tube, wherein:

said high-pressure mercury vapor discharge lamp is so constructed as to be operated at a lamp current of 1.5 A or higher;

the distance between said electrodes and the rated power are set so that the rated power per unit arc length P/d (W/mm) is such that P/d≧88 (W/mm), where d (mm) is the arc length and P (W) is the rated power; and the amount of fill material, the shape of said arc tube, the cross sectional area in the vicinity of tips of said electrodes, the distance between said electrodes, and the rated power are set so that the rated power per unit volume of a discharge arc formed between said electrodes E·j (W/mm$^3$) is such that E·j≧700 (W/mm$^3$), where E (E=V/d) (V/mm) is the lamp voltage per unit arc length, V (V) being the lamp voltage at stable operation and d (mm) being the arc length, and j (j=I/Se) (A/mm$^2$) is the current density at the tips of said electrodes, I (A) being the lamp current at stable operation and Se (mm$^2$) being the cross sectional area in the vicinity of the tips of said electrodes.

2. A short-arc high-pressure mercury vapor discharge lamp comprising a pair of discharge electrodes opposed to each other in an arc tube and enclosing only mercury and a rare gas in said arc tube, wherein:

said high-pressure mercury vapor discharge lamp is so constructed as to be operated at a lamp voltage/lamp current ratio of approximately 37.5 (V/A) or lower;

the distance between said electrodes and the rated power are set so that the rated power per unit arc length P/d (W/mm) is such that P/d≧88 (W/mm), where d (mm) is the arc length and P (W) is the rated power; and the amount of fill material, the shape of said arc tube, the cross sectional area in the vicinity of tips of said electrodes, the distance between said electrodes, and the rated power are set so that the rated power per unit volume of a discharge arc formed between said electrodes E·j (W/mm$^3$) is such that E·j≧700 (W/mm$^3$), where E (E=V/d) (V/mm) is the lamp voltage per unit arc length, V (V) being the lamp voltage at stable operation and d (mm) being the arc length, and j (j=I/Se) (A/mm$^2$) is the current density at the tips of said electrodes, I (A) being the lamp current at stable operation and Se ($mm^2$) being the cross sectional area in the vicinity of the tips of said electrodes.

3. A lamp unit comprising:

a high-pressure mercury vapor discharge lamp according to claims 1 or 2; and a reflector for reflecting light emitted by said high-pressure mercury vapor discharge lamp such that the light is converted into a parallel beam, a convergent beam in which light converges to a predetermined micro-area, or a divergent beam which is substantially the same as light diverged from a predetermined micro-area.

* * * * *